US005746458A

United States Patent [19]

Fisher

[11] Patent Number: 5,746,458

[45] Date of Patent: May 5, 1998

[54] EASILY INSTALLABLE DELAYED EGRESS LOCK SYSTEM

[75] Inventor: Roy E. Fisher, Dover, Ark.

[73] Assignee: Ralph's Welding Inc., Russellville, Ark.

[21] Appl. No.: 909,035

[22] Filed: Aug. 11, 1997

Related U.S. Application Data

[63] Continuation of Ser. No. 645,179, May 13, 1996, abandoned.

[51] Int. Cl.[6] ..... E05C 19/00

[52] U.S. Cl. ..... 292/252; 292/144; 292/341.16

[58] Field of Search ..... 292/252, 92, 144, 292/341.15, 341.16, 148; 248/544; 411/348

[56] References Cited

U.S. PATENT DOCUMENTS

| | | | |
|---|---|---|---|
| 167,663 | 9/1875 | Hanau et al. | 292/341.15 |
| 2,139,193 | 12/1938 | Lamothe et al. | 292/252 |
| 2,180,516 | 11/1939 | Gehnrich | 292/341.15 |
| 2,469,201 | 5/1949 | Mikkelsen | 292/252 |
| 3,553,984 | 1/1971 | Grumbach | 292/341.15 |
| 3,753,316 | 8/1973 | Savarieau et al. | 292/144 |
| 4,006,926 | 2/1977 | Boreback | 292/262 |
| 4,021,065 | 5/1977 | Geringer | 292/144 |
| 4,056,277 | 11/1977 | Gamus et al. | 292/341.16 |
| 4,060,905 | 12/1977 | Light | 33/180 R |
| 4,082,342 | 4/1978 | Ailshie et al. | 296/28 C |
| 4,483,639 | 11/1984 | McCandless, II | 403/317 |
| 4,512,597 | 4/1985 | Nabb et al. | 292/143 |
| 4,557,457 | 12/1985 | Cockfield et al. | 248/544 |
| 4,893,776 | 1/1990 | Floyd | 248/475.1 |
| 5,180,135 | 1/1993 | Hindall | 248/544 |
| 5,429,399 | 7/1995 | Geringer et al. | 292/92 |

*Primary Examiner*—Steven N. Meyers
*Assistant Examiner*—Gary Estremsky
*Attorney, Agent, or Firm*—Stephen D. Carver

[57] ABSTRACT

An easily installed delayed egress lock system that comprises a control module and a latching mechanism attached to the door jamb and a bolt attached to the door. The control module comprises a shell that houses the control circuitry. The latch mechanism comprises a casing that houses a keeper and actuator, two interconnecting channels for retaining the keeper and actuator, and an electrical solenoid. The mechanism also defines a port that receives the bolt when the door is shut. The bolt comprises an elongated body supported by a base and terminating with a spaced-apart head. Preferably, the primary door lock signals the control module when released to start counting down a preselected time period. At the end of the time period, the solenoid deactivates to unlock the door. In the preferred embodiment, the keeper comprises a ball while the actuator comprises a larger ball. The bolt for all embodiments defines a seat that receives the keeper. Installation of the system may be accomplished by first securing the control module and latch mechanism to the door jamb. Next, the bolt is locked into the port with marking dyes covering on each bolt base attachment point. When the door is forcibly shut, the resulting imprint on the door marks the attachment points.

5 Claims, 11 Drawing Sheets

EASILY INSTALLABLE DELAYED EGRESS LOCK SYSTEM

This is a continuation of U.S. patent application Ser. No. 08/645,179, filed May 13, 1996, now abandoned.

BACKGROUND OF THE INVENTION

I. Field of the Invention

This invention relates generally to security devices for exit doors. More particularly, the present invention relates to a delayed egress door lock associated with an arm paddle door lock for panic exits. Known prior art may be found in U.S. Class 292, subclasses 341.19, 201 and 92, respectively.

II. Description of the Prior Art

Incidences of forcible entry or exit from public and commercial buildings have increased dramatically during the recent past. Accordingly, the demand for reliable security systems has increased sharply. Public awareness of rising crime rates, increased attention to crime prevention efforts, and insurance considerations give further impetus to the development of dependable security systems.

Known prior art door locks can be generally categorized as conventional rim locks, deadbolt locks or paddle arm locks. Each door lock type is useful in certain operating environments. For example, rim and deadbolt locks are often used on entrance and exit doors while paddle arm locks are often used on emergency exit doors.

Conventional rim locks are simple, inexpensive locks that perform satisfactorily for many applications. Unfortunately, such locks are generally unsatisfactory for most security applications. They provide only a narrow, usually spring-biased bolt that penetrates a shallow port mounted to the door casing. With minimum force and simple tools, the bolt can be easily pried out of engagement with the catch.

Deadbolt locks, on the other hand, penetrate the door casing and project deeply into a port defined through the door frame. Even with the use of a pry bar, the end of the elongated bolt cannot easily be disengaged from its port. However, conventional deadbolt locks have disadvantages. For example, deadbolt locks often use a key access port. A well-equipped intruder may quickly manipulate the key port and gain forcible entry by destroying the locking components in the cylinder. Moreover, conventional deadbolt locks only secure the unhinged portion of the door. Thus, the lock does not prevent the would-be intruder from removing the door hinges to gain unauthorized entry.

Paddle arm locks are usually associated with emergency exits. These door locks typically comprise a rigid, hollow casing mounted to the interior of the door. A rotatable paddle arm handle mechanically releases an elongated, generally spring-biased latch bolt. One such paddle arm lock is shown in U.S. Pat. No. 5,139,292, issued Aug. 18, 1992, to L. Ralph Beals. The Beals patent discloses a preferred paddle arm lock that is hereby incorporated by reference. Paddle arm locks, including Beals' lock, also commonly comprise some form of built-in alarm system for alerting persons in the building that the door has been unlocked.

Another significant recent problem involves the abuse of emergency exits in commercial or public facilities. Since these emergency or panic exit doors provide rapid egress for individuals from a building, thieves and other wrongdoers have begun using these exits as convenient escape routes. Thus, there are circumstances where immediate availability of the exit is not desirable. One solution to such dastardly practices is to permanently encumber the door.

Unfortunately, this solution prevents door use during genuine emergency circumstances and is often prohibited by law.

As previously mentioned, some prior locks attempt to solve the problem by sounding an alarm when the door is unlocked. Unfortunately, such alarms generally fail to provide sufficient reaction time for authorized personnel to verify the emergency before opening the door. Furthermore, it is often desirable to maintain the secured status of emergency exits in some operating environments until authorized personnel can assist the evacuees. For example, it is desirable to maintain the security of hospital emergency exits to prevent patients from wandering out emergency exits without proper assistance.

In most modern buildings, the National Fire Protection Association (NFPA) and similar building code authorities permit the installation of delayed egress systems to prevent shoplifting. Such systems delay exit door activation after paddle depression for a brief period of time, generally fifteen to thirty seconds. An audible signal is generated during the delay period that allows security personal to assess the emergency situation and stop people from using the exits fraudulently.

National standards of performance for delayed egress locks have already been established. Such standards are found in ANSI/BHMA section 156.24. These standards establish operating parameters for timed release or delayed egress door locks that are different from other normal types of door locks.

Conventional delay mechanisms can be grouped as either primary or auxiliary lock delays. In other words, the delay mechanism is combined with the primary lock latch to form an unitary system or physically separated from the primary latch and it is combined with an auxiliary latch of some type.

Known prior art using primary lock delays are seen in U.S. Pat. Nos. 4,328,985, 5,011,199, 5,035,450 and 5,085,475. Most of these emergency exit devices combine a paddle door lock with an internal delaying mechanism directly associated with the door latchbolts. Normally, the paddle lock housing contains an internal linkage that connects the latchbolts to the paddle. The linkage moves the latchbolts in response to paddle depression to release the exit door. In the above referenced patents, the delay mechanism is generally interposed between the paddle and the latchbolts to prevent the immediate opening of the exit door.

One problem associated with interposed delay mechanisms is that they normally require complicated internal arrangements to function properly. These complicated arrangements are difficult to manufacture. They are also prone to failure in critical emergency situations.

Known prior art devices employing auxiliary delay latch systems are seen in U.S. Pat. Nos. 4,314,722 and 4,540,208. In both of these systems, the time delay mechanism controls an auxiliary lock that prevents door opening even though the primary lock has opened. However, these systems both employ control mechanisms at least partly dependent upon hydraulic fluids. One problem with fluid control devices is that they are often susceptible to variable operation during extreme temperature conditions, which could easily become problematic during a fire. Other prior art devices of general relevance include U.S. Pat. Nos. 4,682,801 and 4,871,204.

Another vexatious problem with most of the known prior art involves the difficulty of installation. It is often not a simple matter to install auxiliary locks or to replace primary locks with time delay devices. Thus, a need exits for an easily installable auxiliary time delay lock that may be retrofitted to existing primary locks.

Hence, it is desirable to provide a security locking system that positively locks a door against undesired intrusions and that also provides a delay mechanism to overcome the disadvantages associated with other delay mechanisms. An ideal delayed egress system should be easily retrofittable to exiting paddle arm locks. An easily installable system would be especially desirable.

SUMMARY OF THE INVENTION

The present invention provides an auxiliary time delay lock system that temporarily immobilizes doors after the primary lock opens. The subsequent time delay permits authorized personnel to verify the emergency before permitting uncontrolled egress from the facility. In other words, the delayed egress lock system requires that a predetermined time period expire between the initial effort of forcing entry through a locked door and the final act of gaining entry, permitting a sufficient reaction time to stop or report unauthorized egress.

The proposed locking system also withstands high withdrawal forces. The system's latch arrangement advantageously uses round surfaces to evenly dissipate and/or transfer the withdrawal forces to the frame of the door. Unlike other systems, the present system does not transmit the entire withdraw force of the door to a particular link in the latch housing. Thus, the present system is able to withstand higher withdrawal forces than other known systems. Another advantage of the present invention is the ease of both installing it and retrofitting it to existing doors and/or primary locks.

As mentioned previously, the disclosure of U.S. Pat. No. 5,139,292, issued Aug. 18, 1992, to L. Ralph Beals is incorporated herein by reference. The paddle arm lock disclosed by Beals overcomes several problems associated with prior art locks but does not teach a delay mechanism to prevent the problems discussed hereinabove. Preferably the system is installed to cooperate with a primarily lock, such as that proposed in Beals, that is already mounted upon the door. In such installations, the system is activated by the release of the primary door lock.

Three embodiments of the proposed system, a preferred embodiment and two alternatives, are discussed in greater detail hereinafter. However, since all embodiments are similar, like terms will be used throughout whenever possible. For example, all three embodiments comprise a control module, a latching mechanism and a bolt. Furthermore, the control module is identical for all three embodiments and all three embodiments mount similarly. The primary differences among the embodiments involves the respective shapes and dimensions of the keepers, actuators, their respective channels and the bolts.

Preferably, both the control module and latching mechanism are securely mounted to the upper corner of a selected door's jamb. Of course, the latching mechanism can be spaced away from the module as long as the mechanism is electrically connected to the module. The bolt is generally mounted oppositely on the door. However, with relatively minor modifications to the structure of the bolt and the control mounts, the bolt could be mounted on the jamb and the control module and latching mechanism could be mounted on the door.

The control module comprises a protective, hollow shell that generally houses all of the electrical components required to manage the system. In other words, the junctions, connections, circuitry, alarms and related equipment and wiring are all housed inside a protective shell. Preferably, the primary door lock is wired to the control module to signal when the primary latch releases so that the system begins counting down.

The latch mechanism comprises an elongated casing with an entry port. The casing protectively houses the internal latching components. The port receives the bolt when the door is closed. The internal components of the latching mechanism include the keeper and its actuator, the respective channels for both the keeper and actuator, and an electrical solenoid for controlling the keeper and actuator. The mechanism may also house alarms, testing devices or other equipment as necessary.

The bolt generally comprises a body supported by a base directly mounted to the door. The body terminates at a distal head. During use, most of the body and head enter and reside in the latch port.

Since most doors open and close arcuately, it is anticipated that a slight tapering at the bolt head will facilitate smooth entry into the mechanism. The angle of inclination most desirable is between four and eight degrees, most preferably 6.5 degrees. In the preferred embodiment, a half degree difference in the bolt head angle of inclination and the interior of the mechanism further prevents sticking or jamming. When the bolt is inserted into the port and the keeper is actuated, the keeper mates with a seat in the body to captivate the bolt therein. Of course, when the control releases the latch, the keeper must be dislodged from the seat. Thus, a converse displacement angle is required to dislodge the keeper from the seat. It has been found that a preferable displacement angle is between twenty-five and thirty-five degrees, preferably 30 degrees.

While the door is locked, the keeper captivates the bolt head in the latch port. In other words, as long as the control module provides power to the solenoid in the latching mechanism, the door remains locked even though the primary lock has opened. However, as soon as the primary lock releases, the control module begins counting down a preselected time period. At the end of the preselected time period, the control module interrupts the power supply to unlock the door. More specifically, the control module disrupts power to the solenoid, thereby de-energizing it and causing its plunger to contract. After the plunger withdraws, the keeper and actuator may move freely in their respective channels. Thereafter, whenever pressure is exerted on the door, the keeper moves out of the seat, permitting the withdrawal of the bolt from the port.

In the preferred embodiment, the keeper comprises a ball while the actuator comprises a slightly larger ball. The bolt comprises a body that has a conic head atop a cylindrical shaft. An annular ring defined in the shaft comprises the seat.

In the first alternative embodiment, the keeper comprises a flat disc while the actuator comprises a slightly larger flat disc. The bolt comprises a flat, tapered plate and the seat comprises an arcuate recess defined in the plate perimeter.

In the second alternative embodiment, the keeper comprises two spaced-apart chain links while the actuator comprises the links joining the keeper links. The bolt comprises a flat plate and the seat comprises an arcuate recess with a pair of opposed, spaced apart locking recesses therein.

Installation of the system may be accomplished in several easy steps. First, the control module and latch mechanism are secured to the upper door jamb corner. Next, the bolt is inserted into the latch mechanism and locked therein. Marking dyes are then placed on each attachment point of the bolt base. Finally, the door is forcibly shut. Each marking dye imprints the proper location for each attachment point on the door. The imprints can then be conventionally drilled out for bolt attachment.

Thus, a principal object of the present invention is to provide an auxiliary time delay lock of the character described hereinbefore that temporarily prevents a door from opening for a predetermined time period after the primary lock releases.

A related object of the present invention is to provide an auxiliary time delay lock system that may be easily installed.

Another related object of the present invention is to provide an auxiliary time delay lock system that may be retrofitted to existing primary locks.

Yet another related object of the present invention is to provide an auxiliary time delay lock system that is particularly well suited for retrofitting to paddle arm locks with existing alarm signal devices.

A basic object of the present invention is to provide a time delay system that alerts authorized personnel when a door is accessed while temporarily preventing egress from the door.

Another basic object of the present invention is to prevent thieves from using emergency exits as quick escape routes.

A more basic object of the present invention is to provide an auxiliary lock system that retards unauthorized egress from a building.

A related object of the present invention is to provide a system that temporarily immobilizes emergency exits.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
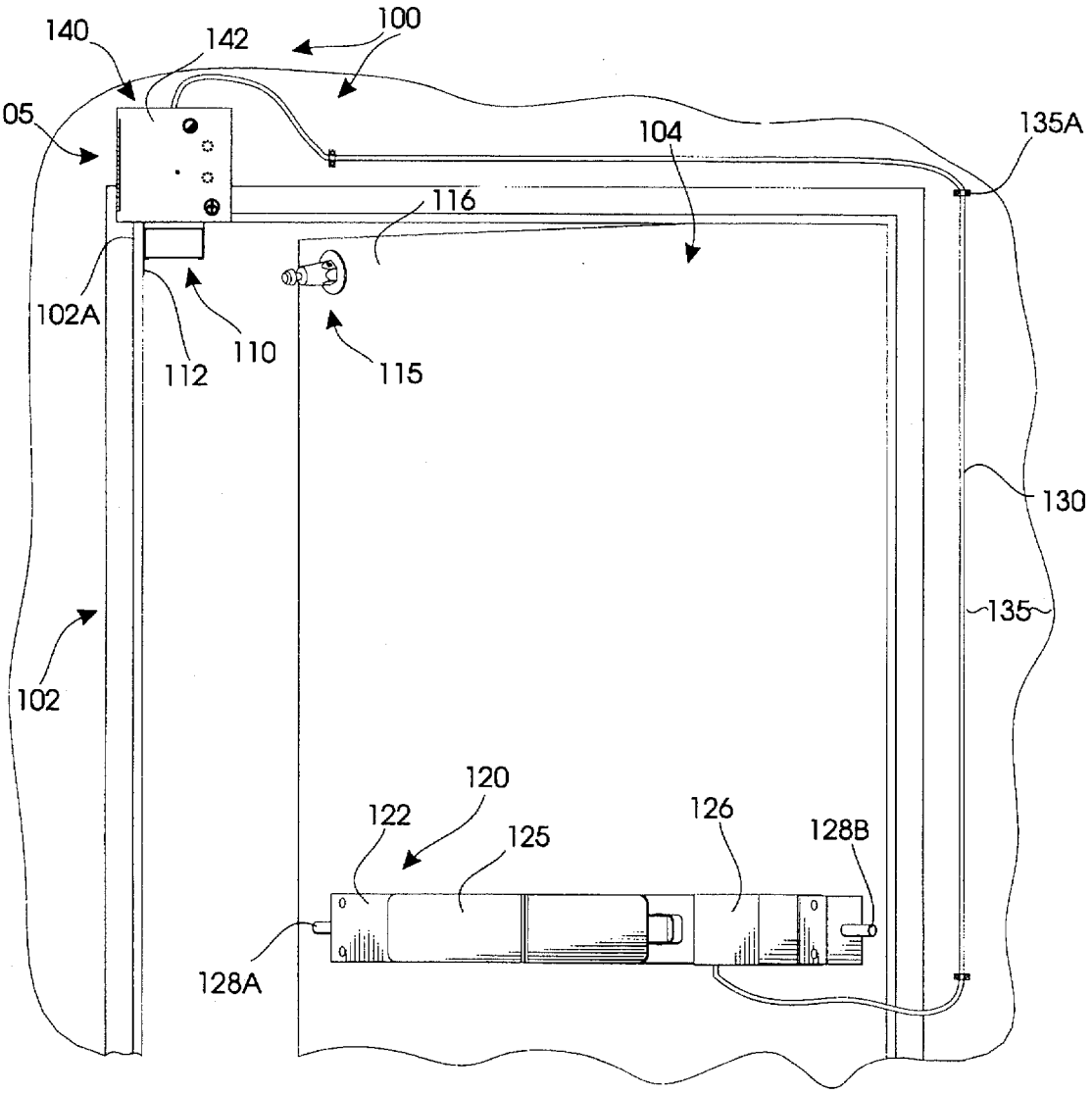
FIG. 1 is an environmental view of my Easily Installable Delayed Egress Lock System, with lower door, door jamb and surrounding wall cut away to allow enlargement of the view.
Figure 2:
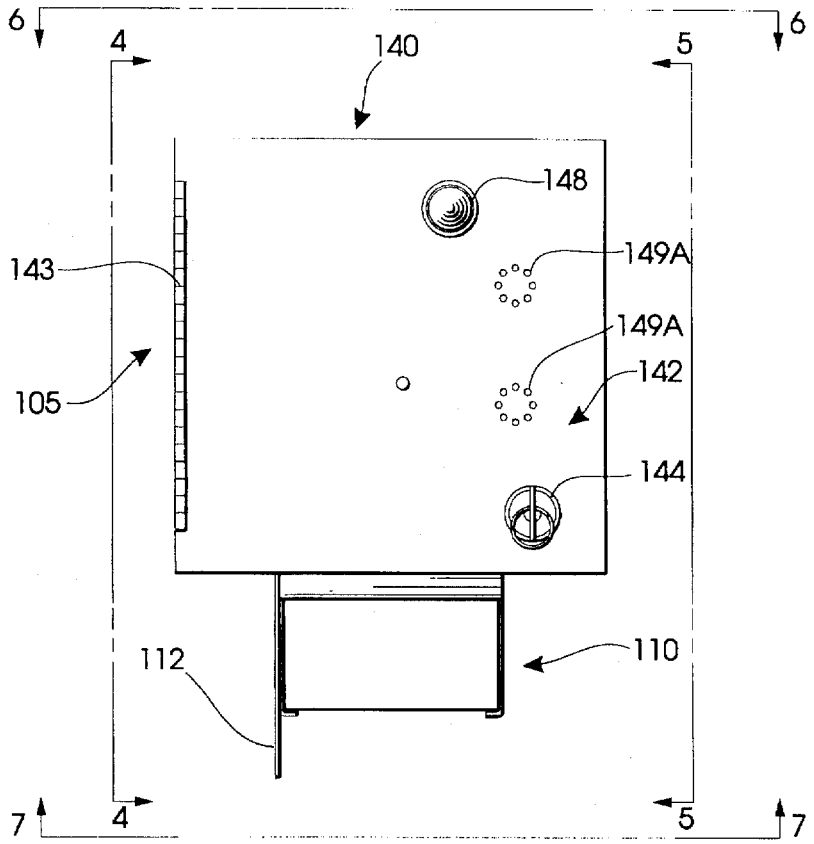
FIG. 2 is a front elevational view of the control module with its door in a closed position, the latching mechanism and door jamb mounting plate.
Figure 3:
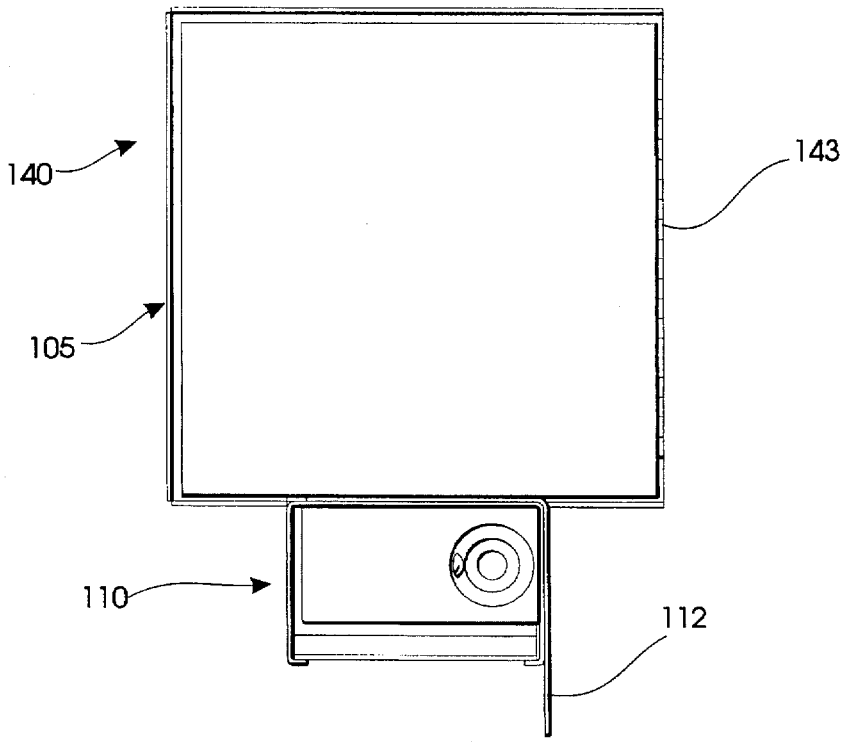
FIG. 3 is a rear elevational view of the components shown in FIG. 2.
Figure 4:
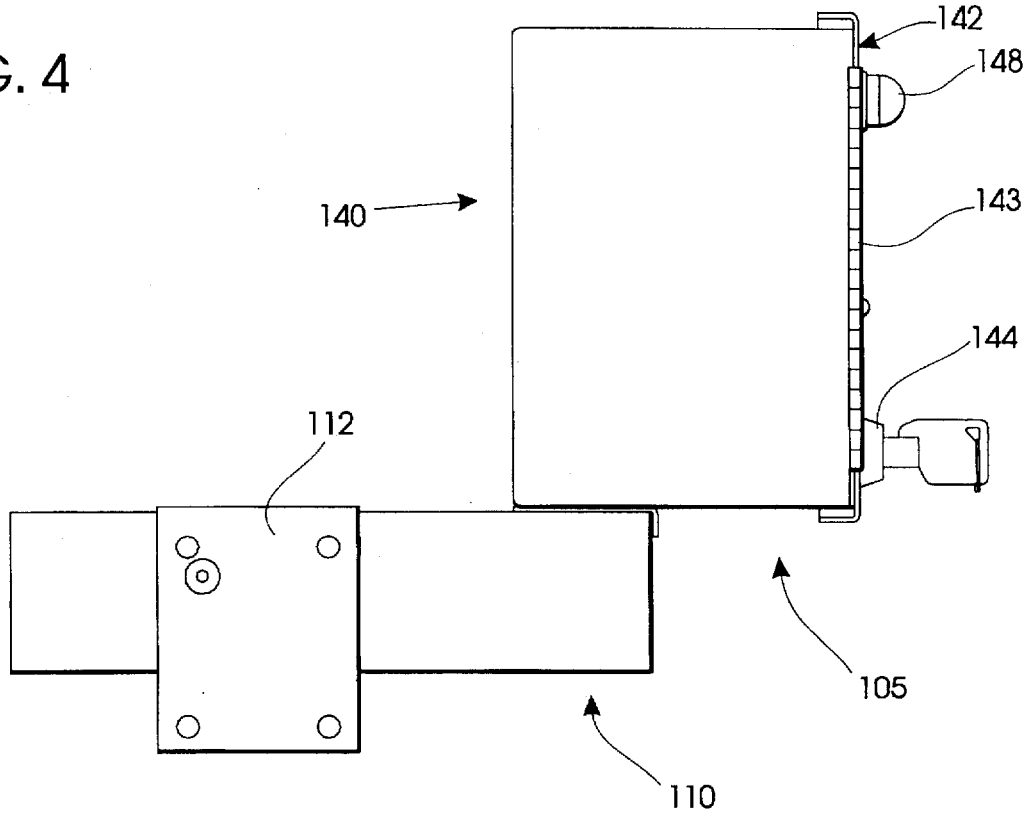
FIG. 4 is a left side elevational view taken generally along line 4—4 of FIG. 2.
Figure 5:
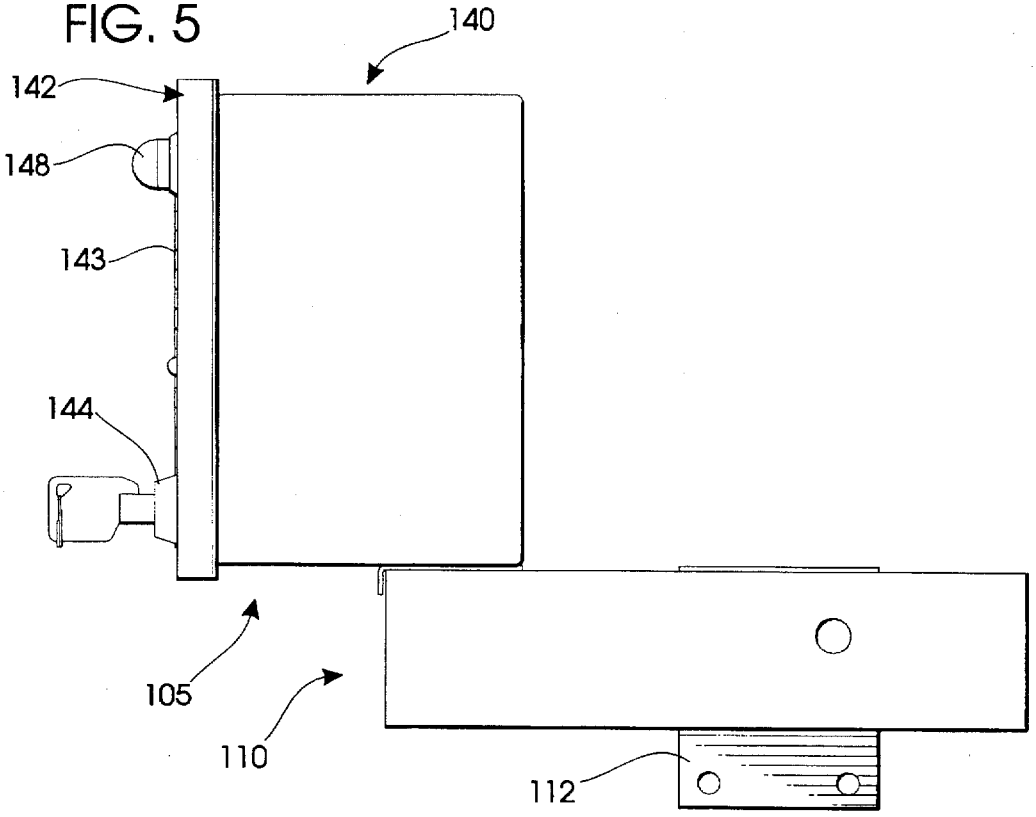
FIG. 5 is a right side elevational view taken generally along line 5—5 of FIG. 2.
Figure 6:
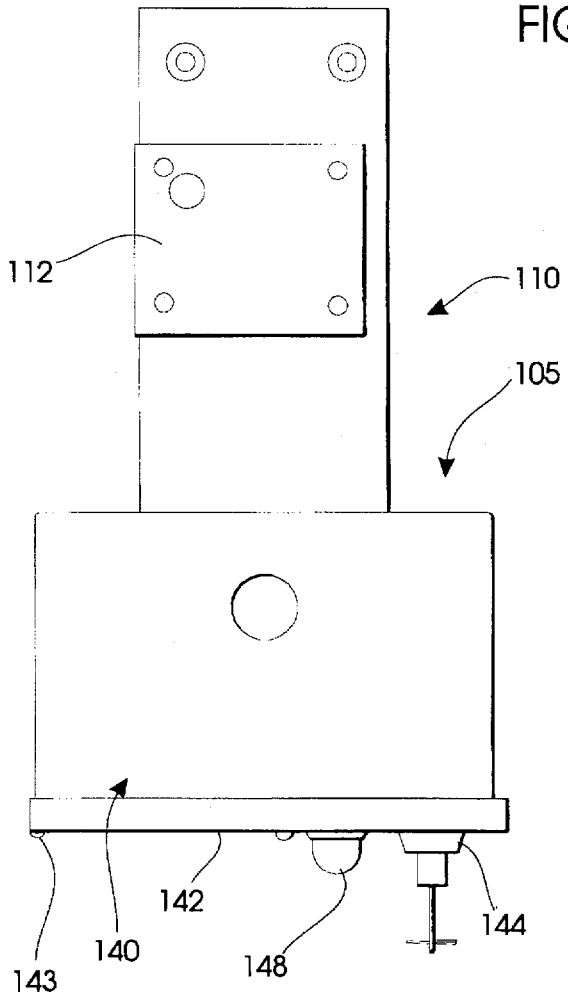
FIG. 6 is a top plan view taken generally along line 6—6 of FIG. 2.
Figure 7:
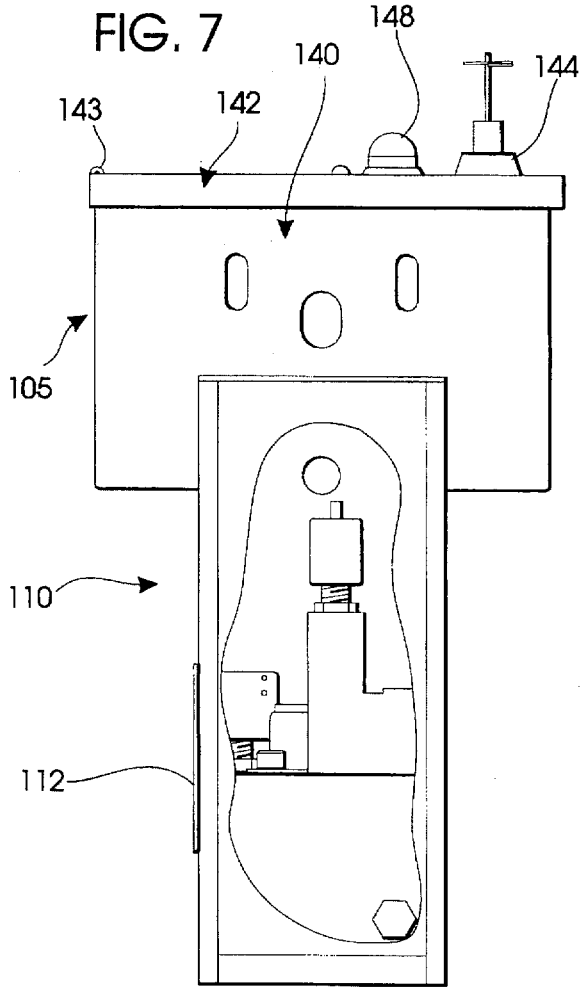
FIG. 7 is a bottom plan view taken generally along line 7—7 of FIG. 2, with parts thereof broken away or omitted for clarity.

With reference now to the accompanying drawings, a Easily Installable Delayed Egress Lock System constructed in accordance with the teachings of this invention is generally designated by the reference numeral 100 (FIG. 1). System 100 is preferably mounted adjacent to the overhead section 102A of door jamb 102 associated with the selected door 104. The installation of system 100 is discussed in more detail hereinafter.

The system 100 comprises a control module 105, a latching mechanism 110 and a bolt 115. Preferably, system 100 is operatively associated with a primary door lock 120.

Although system 100 may be used with any type of primary door lock, it is envisioned that door locks of the paddle arm lock type may be particularly utilized advantageously with the present invention. As mentioned previously, the disclosure of U.S. Pat. No. 5,139,292, issued Aug. 18, 1992, to L. Ralph Beals is especially well-suited for use with the present invention and its teachings are expressly incorporated herein by reference.

Referring back to FIG. 1, door 104 is equipped with a commercially available paddle arm lock 122. Preferably, the lock 122 is a Series THPA lock manufactured by Positive Lock Manufacturing of 402 east 39th street, Russellville, Ark. Of course, a similar model manufactured by another manufacturer would also be suitable.

As previously stated, three embodiments of the proposed system will be discussed in great detail hereinafter. However, since all embodiments are similar, like terms will be used throughout whenever possible. In other words, since all three embodiments comprise a control module, a latching mechanism and a bolt, these terms will be used for all embodiments. Furthermore, since the control module is identical for all three embodiments and since all three embodiments mount similarly, the control module and installation procedure will only be described in detail once.

Figure 8:
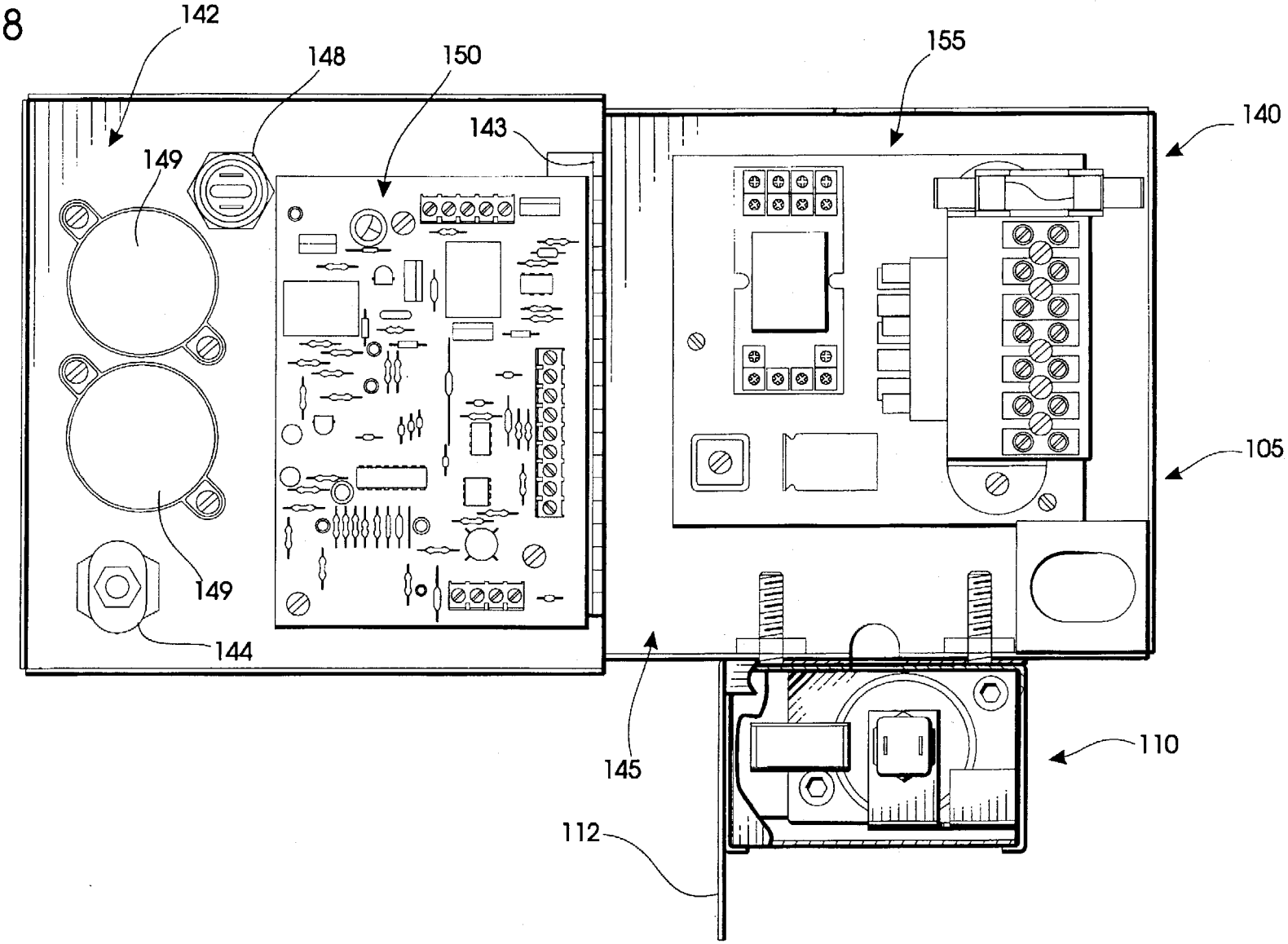
FIG. 8 is a front elevational view of the components shown in FIG. 2 but with the control module door open to expose the internal components and showing the internal mounting of the latching mechanism to the control module, with parts thereof broken away or omitted for clarity.
Figure 9:
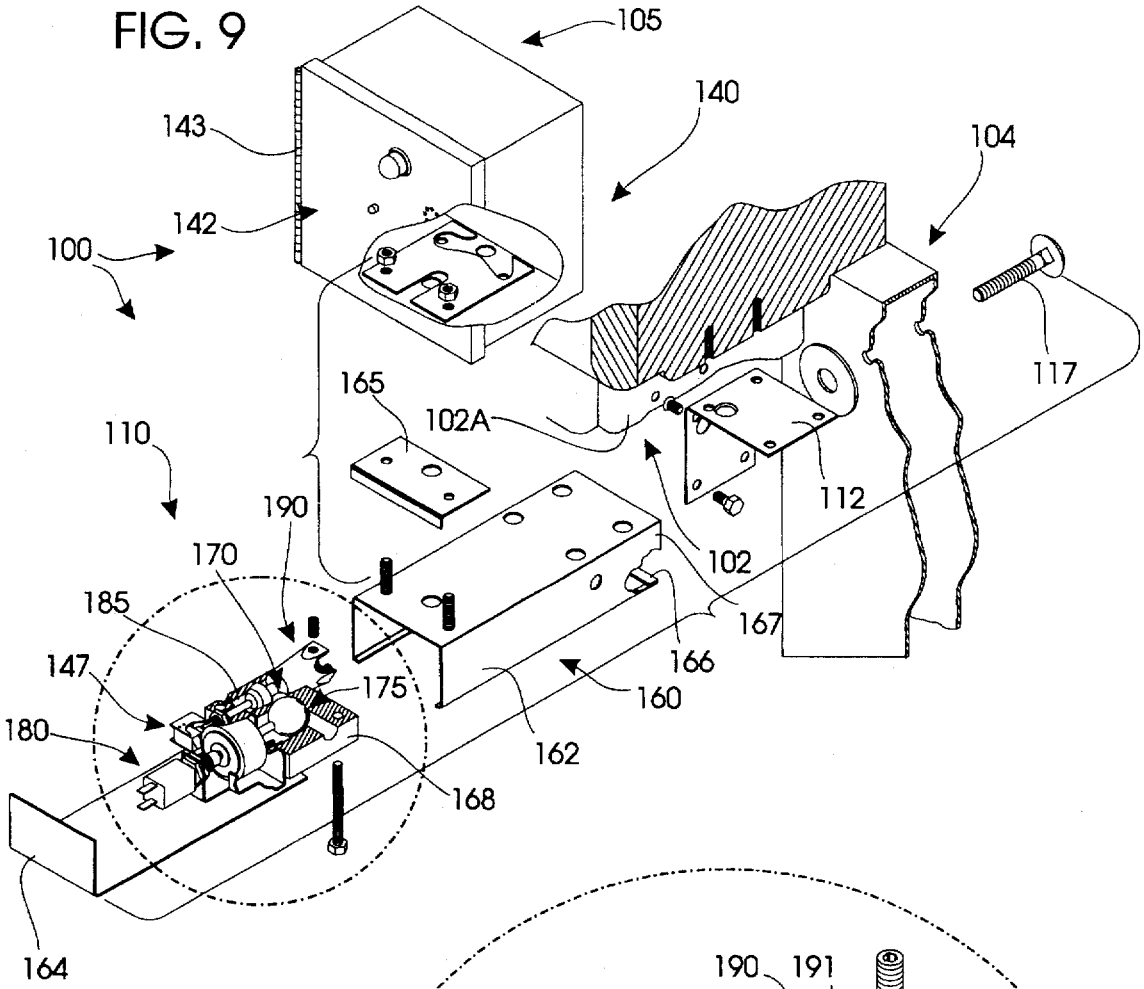
FIG. 9 is a partially exploded, fragmentary isometric view showing the preferred embodiment of the latching mechanism and the bolt, with parts thereof broken away or omitted for clarity.

In all three contemplated embodiments, the control module 105 and latching mechanism 110 secure to the door jamb 102 via bracket 112 while the bolt mounts on door 104 via stud 117 (FIGS. 1 and 9). The control module 105 rigidly and operatively couples to the latching mechanism 110 (FIGS. 1–8). Alternatively, the control module 105 could be remotely located as long as it was electrically connected to mechanism 110.

An electrical cable 130 runs from an alarm 126 (discussed fully in the Beals patent) to control module 105. Cable 130 is appropriately strung on wall 135 using keepers 135A as necessary along a suitable route to control module 105. Of course, any lock with a switch or other arrangement capable of electrically firing can be used to trigger system 100. System 100 can also be wired into a smoke or fire alarm and triggered by their operation.

When a person presses against paddle 125, the lock withdraws latchbolts 128A, 128B from the door jamb 102. However, such paddle depression triggers system 100 via alarm 126. As previously stated, system 100 prevents the door 104 from opening until a preselected time period expires. In addition to paddle depression, other devices, such as building alarms, smoke alarms, fire alarms, etc., depending upon the constraints of a particular installation, could be adapted to trigger system 100.

Figure 10:
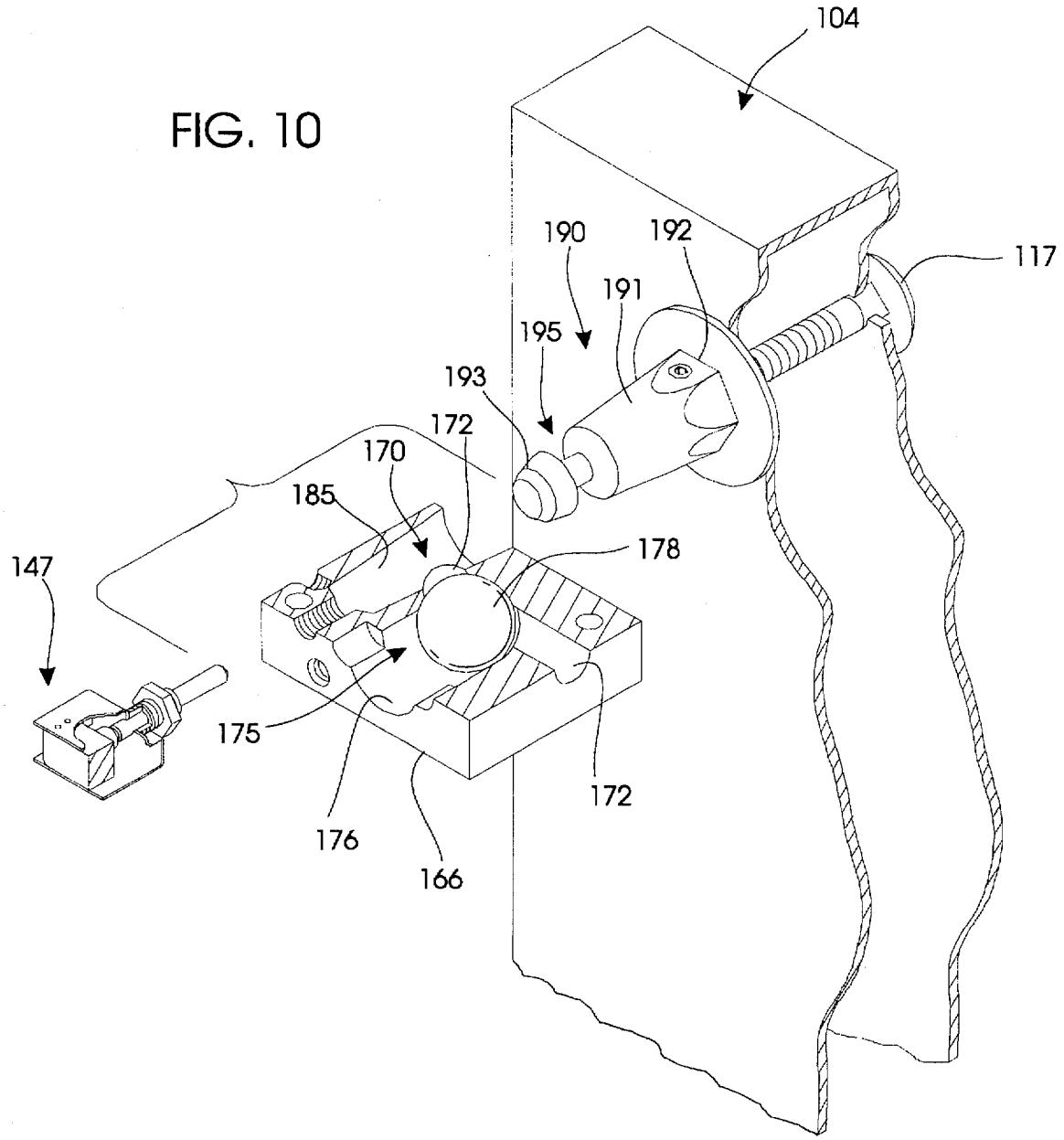
FIG. 10 is a partially exploded, fragmentary isometric view showing the bolt attached to a door and a portion of the latching mechanism with parts omitted or broken away for clarity.
Figure 11:
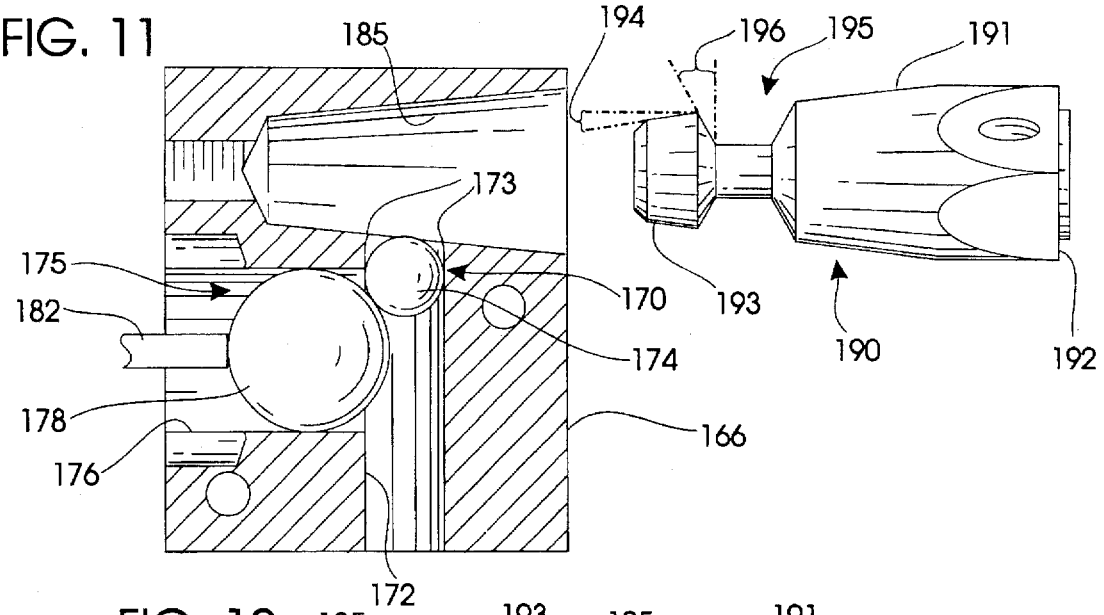
FIG. 11 is a top plan view of the preferred bolt and latching mechanism shown in FIG. 10, with parts omitted or broken away for clarity.
Figure 12:
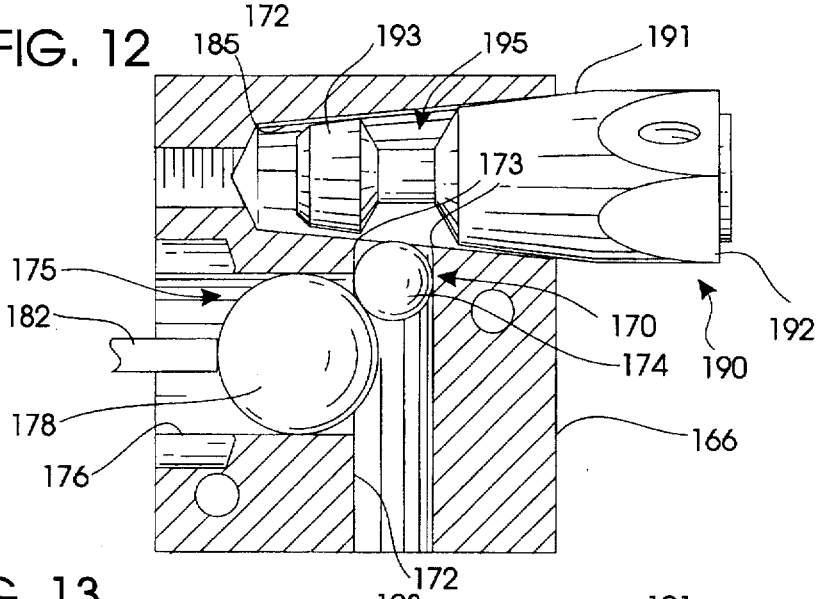
FIG. 12 is a top plan view similar to FIG. 11, but showing the bolt inside the port, with parts omitted or broken away for clarity.
Figure 13:
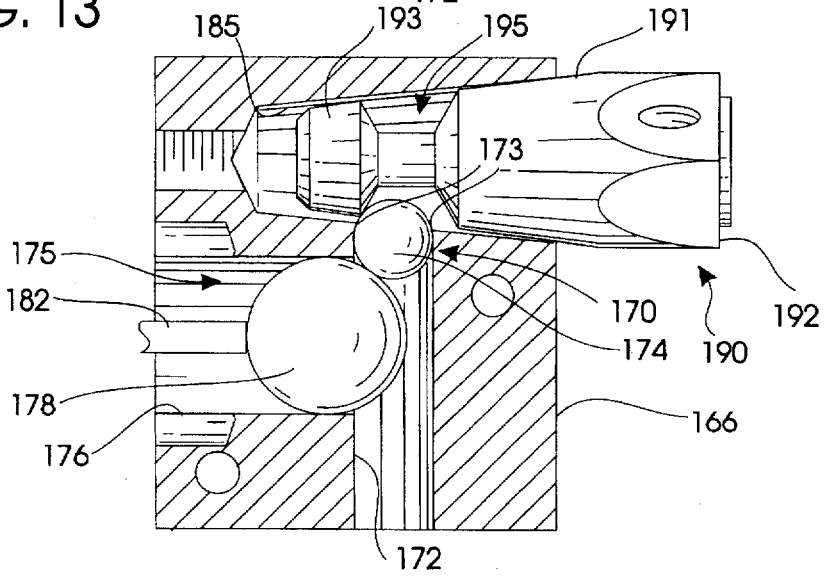
FIG. 13 is a top plan view similar to FIGS. 11 and 12, but showing the bolt locked inside the port, with parts omitted or broken away for clarity.
Figure 14:
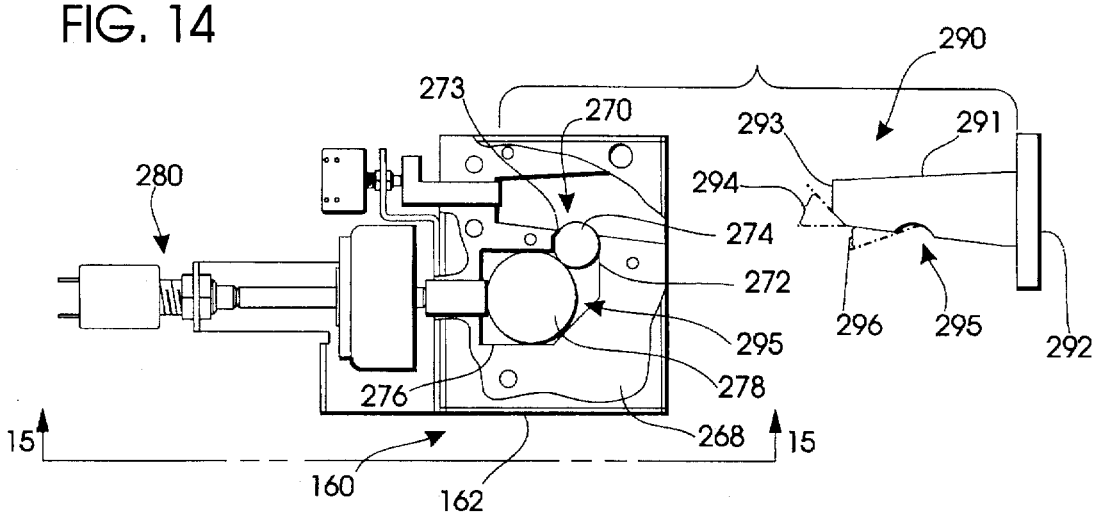
FIG. 14 is a partially fragmented, top plan view of a first alternative embodiment employing a disc keeper and actuator and a flat bolt, with parts broken away or omitted for clarity.
Figure 15:
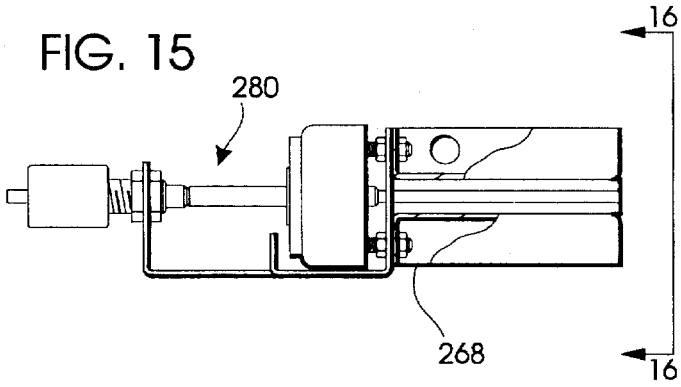
FIG. 15 is a partially fragmented, side elevational view of FIG. 14 as viewed from line 15—15, with parts broken away or omitted for clarity.
Figure 16:
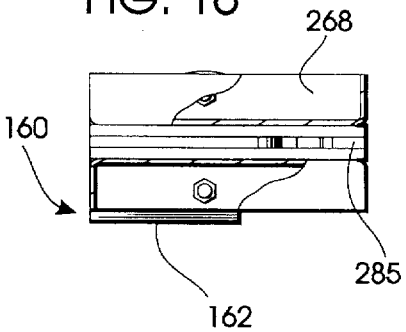
FIG. 16 is a partially fragmented, end elevational view of FIG. 15 as viewed from line 16—16, with parts broken away or omitted for clarity.
Figure 18:
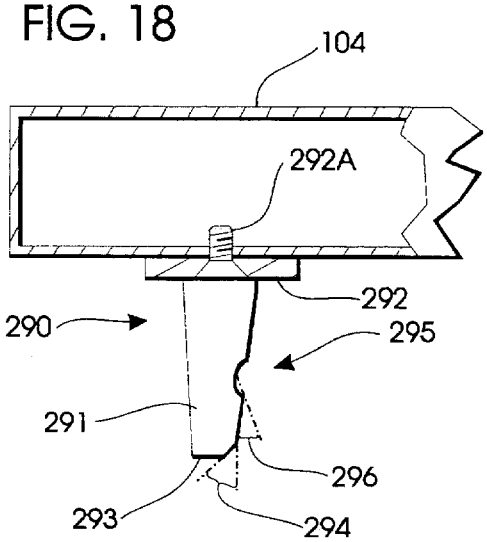
FIG. 18 is a cross-sectional view taken generally along line 17—17, with parts broken away or omitted for clarity.
Figure 17:
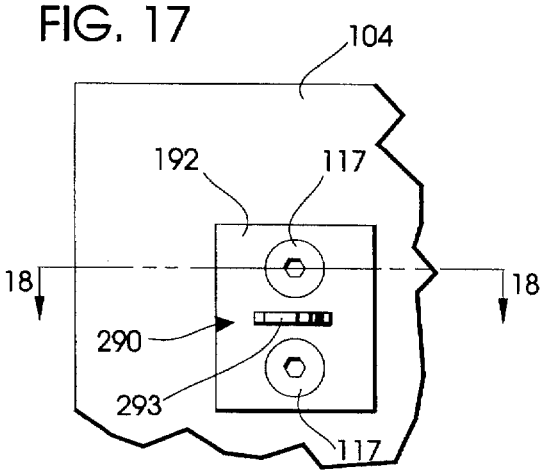
FIG. 17 is a front elevational view showing the bolt mounted to a door.

Upon paddle depression, system 100 initiates a timer in control module 105. Control module 105 comprises a protective, box-like, hollow shell 140 that houses the timing circuitry and related circuitry as well as various accessories for system 100. Shell 140 can be readily constructed from any conventional rigid metal known in the industry. A hinged door 142 controls access to the shell interior 145 (FIG. 8). Hinge 143 facilitates door movement while a door latch 144 prevents unauthorized persons from accessing interior 145. Internal lock sensor 147 (FIG. 10), signal light 148 and speakers 149 (FIGS. 2 and 8), with corresponding sound emitting perforations 149A in door 142, are examples of accessories that may be utilized with system 100.

A circuit board 150 controls the operation of system 100. As will be immediately recognized by persons skilled in electronics, the circuit board 150 can be made in literally thousands of different configurations. Thus, board 150 will not be particularly described in detail. Board 150 receives input signals and power via wiring harness 155. Harness 155 connects to board 150 conventionally. Signals are output from board 150 via harness 155 to accessories 148, 149 and latching mechanism 110.

The latching mechanism 110 is generally the same for all three embodiments. However, for clarity, the specific details of each latching mechanism for each embodiment will be discussed separately. In the preferred embodiment, latching mechanism 110 comprises an elongated, parallelepiped frame 160. Frame 160 internally houses an internal keeper 170, its actuator 175 and a locking solenoid 180 (FIG. 9). Frame 160 comprises an upper mounting subframe 162 that receives a sliding bottom 164. A flanged plate 165 anchors bottom 164 in subframe 162.

Figure 9A:
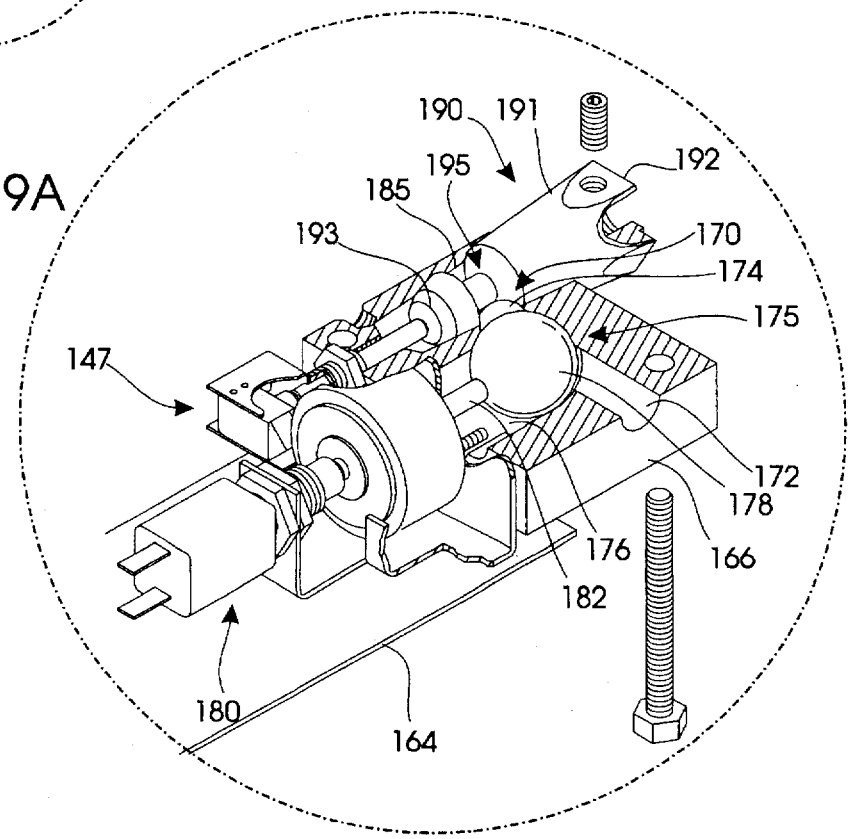
FIG. 9A is an enlarged, fragmentary isometric view of the encircled section shown in FIG. 9.

The assembled frame 160 defines a terminal orifice 166 at end 167. The subframe secures an internal block 168 adjacent orifice 166. Block 168 secures the keeper 170, actuator 175 and solenoid 180 (FIG. 9A) inside frame 160.

In the preferred embodiment, block 168 internally defines a keeper channel 172. An inwardly projecting lip 173 restrains keeper 170 at the interior end of channel 172. Keeper 170 comprises a sphere 174 (FIGS. 9A–13) that may freely roll along channel 172.

An actuator 175 normally abuts keeper 170 to restrict keeper movement along channel 172. The actuator resides in a channel 176 that intersects channel 172. While channel 176 preferably intersects channel 172 at approximately its midpoint, the intersection could be moved with a corresponding change in the dimensions of the keeper and actuator. However, experimental research has shown that a keeper to actuator ratio of approximately 1 to 4 provides the greatest resistance to withdrawal forces during a locked configuration while simultaneously requiring the smallest release forces during an unlocked configuration. The actuator preferably comprises a sphere 178 that rolls along channel 176.

A conventional electrical solenoid 180 controls actuator 175 movement along channel 176. When the system 100 locks door 104, a plunger 182 protruding outwardly from solenoid 180 along channel 176 pushes the actuator toward channel 172 and keeper 170. When the system 100 unlocks door 104, the plunger 182 withdraws into solenoid 180 to permit actuator 175 to travel away from channel 172 and keeper 170. Any subsequent withdrawal force on door 104 forces keeper 170 to move in against actuator 175. Since the locking force of solenoid 180 has been withdrawn, the movement of keeper 170 against actuator 175 forces actuator 175 toward solenoid 180 along channel 176. Such actuator movement permits keeper 170 to withdraw from its locking engagement against bolt 190 and subsequently unlocks door 104. Block 168 further defines a tapered port 185 that accepts bolt 190.

Bolt 190 comprises an elongated, tapering cylindrical shaft 191. Shaft 191 tapers from a flat, circular base 192 to a terminating conical head 193. Preferably, conical head 193 forms an angle of entry 194 that is between 4 and 8 degrees, most preferably 6.5 degrees. The angle of entry 194 facilitates smooth bolt entry into the port.

An annular seat 195 is defined in shaft 191 between the base 192 and the head 193. Bolt 190 preferably mounts appropriately on door 104 via stud 117 as is discussed more fully hereinafter. When bolt 190 is inserted fully into port 185, seat 195 may receive keeper 170. While keeper 170 is inserted and retained in seat 195 by actuator 175, door 104 remains locked. The walls of seat 195 form an angle of withdrawal 196 that is between 25 and 35 degrees, most preferably 30 degrees. When keeper 170 is released, the angle of withdrawal 196 forces keeper 170 out of seat 195. As mentioned previously, the alternative embodiments are structurally quite similar to the preferred embodiment. Nevertheless, both alternative embodiments will now be discussed with appropriate reference numerals for clarity.

In the first alternative embodiment (FIGS. 14–18), block 268 internally defines a keeper channel 272. An inwardly projecting lip 273 restrains keeper 270 at the interior end of channel 272. Keeper 270 comprises a flat disc 274 that may freely move along channel 272.

An actuator 275 normally abuts keeper 270 to restrict keeper movement along channel 272. The actuator resides in a channel 276 that intersects channel 272. Unlike the preferred embodiment, channel 276 forms a terminal end of channel 272. Preferably, the keeper to actuator ratio remains approximately 1 to 4 to provide the greatest resistance to withdrawal forces during a locked configuration while simultaneously requiring the smallest release forces during an unlocked configuration. The actuator preferably comprises a flat disc 278 similar to disc 274. Disc 278 also moves along channel 276.

A conventional electrical solenoid 280 controls actuator 275 movement along channel 276. When the system 100 locks door 104, a plunger 282 protruding outwardly from solenoid 280 along channel 276 pushes the actuator toward channel 272 and keeper 270. When the system 100 unlocks door 104, the plunger 282 withdraws into solenoid 280 to permit actuator 275 to travel away from channel 272 and keeper 270. Any subsequent withdrawal force on door 104 forces keeper 270 to move in against actuator 275. Since the locking force of solenoid 280 has been withdrawn, the movement of keeper 270 against actuator 275 forces actuator 275 toward solenoid 280 along channel 276. Such actuator 275 movement permits keeper 270 to withdraw from its locking engagement against bolt 290 and subsequently unlocks door 104. Block 268 further defines a tapered port 285 that accepts bolt 290.

Bolt 290 comprises an elongated, tapering flat shaft 291. Shaft 291 tapers from a flat base 292 to a terminal head 293. Preferably, the head 293 defines an angle of entry 294 that is between 4 and 8 degrees, most preferably 6.5 degrees. The angle of entry 294 facilitates smooth bolt entry into the port.

An arcuate seat 295 is defined in shaft 291 between the base 292 and the head 293. Bolt 290 preferably mounts appropriately on door 104 via attachment points 292A as is discussed more fully hereinafter. When bolt 290 is inserted fully into port 285, seat 295 may receive keeper 270. While keeper 270 is inserted and retained in seat 295 by actuator 275, door 104 remains locked. The walls of seat 295 form an angle of withdrawal 296 that is between 25 and 35 degrees, most preferably 30 degrees. When keeper 270 is released, the angle of withdrawal 296 forces keeper 270 out of seat 295.

Figure 19:
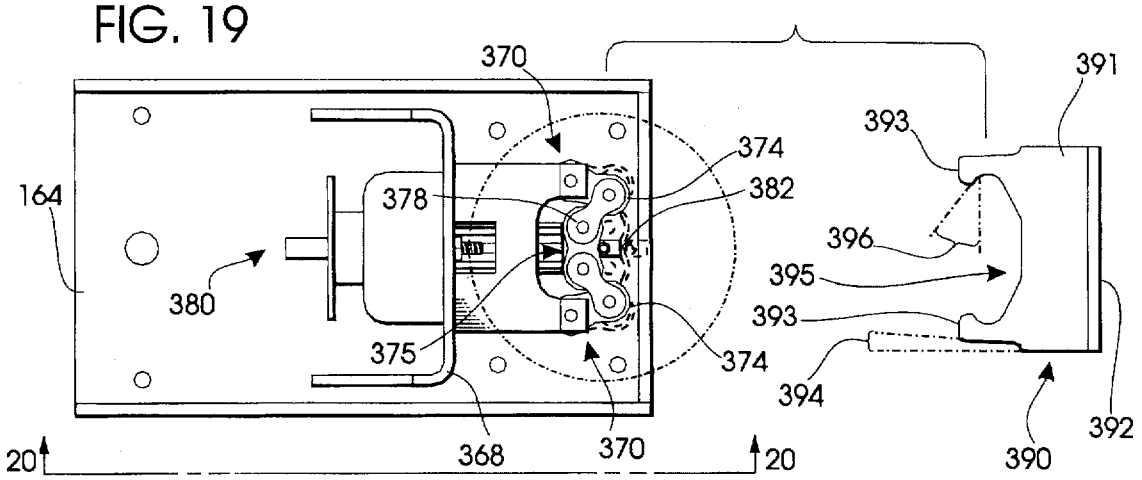
FIG. 19 is a top plan view of a second alternative embodiment employing a chain keeper and a flat bolt, with the dashed lines showing a moved position and with parts broken away or omitted for clarity.
Figure 19A:
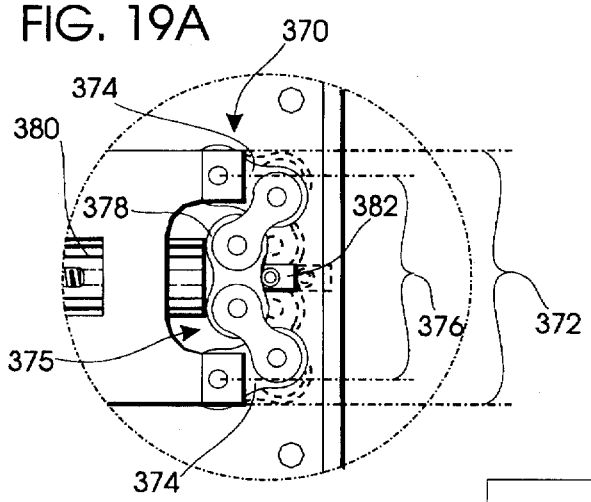
FIG. 19A is an enlarged, fragmentary top plan view of the encircled section shown in FIG. 19.
Figure 20:
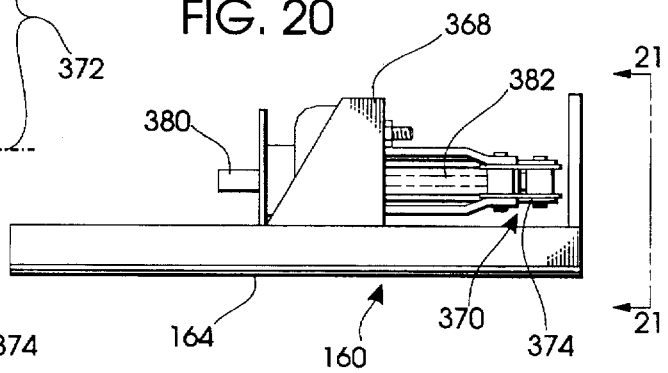
FIG. 20 is a side elevational view of FIG. 19 as viewed from line 20—20, with parts broken away or omitted for clarity.
Figure 21:
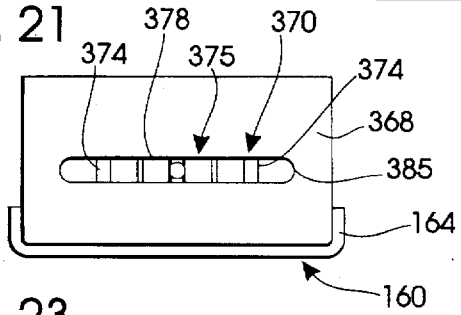
FIG. 21 is a side elevational view of FIG. 20 as viewed from line 21—21, with parts broken away or omitted for clarity.
Figure 22:
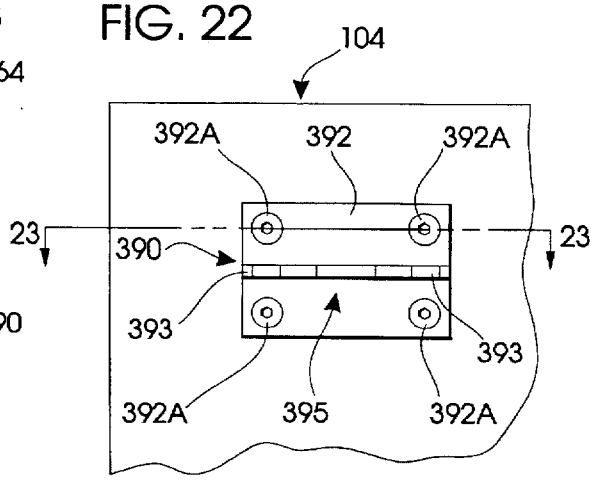
FIG. 22 is a front elevational view showing the bolt mounted to a door.
Figure 23:
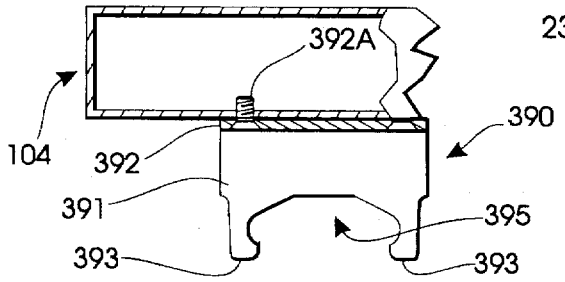
FIG. 23 is a cross-sectional view taken generally along line 23—23, with parts broken away or omitted for clarity.

In the second alternative embodiment (FIGS. 19–23), block 368 defines a keeper channel 372. The keeper 370 comprises a pair of spaced apart chain links 374 that may move freely through channel 372 (FIG. 19A). An actuator 375 abuts keeper 370 to restrict keeper movement along channel 372. The actuator moves through a smaller channel 376 that is inside channel 372. Unlike the preferred embodiment and the first alternative embodiment, channel 376 is smaller than channel 372. The actuator preferably comprises coupling chain links 378 that connect the spaced apart keeper links 374.

A conventional electrical solenoid 380 controls actuator 375 movement along channel 376. When the system 100 locks door 104, a plunger 382 protruding outwardly from solenoid 380 along channel 376 pushes the actuator toward channel 372 and keeper 370. Importantly, plunger travel is limited to prevent actuator 374 from going overcenter. When the system 100 unlocks door 104, the plunger 382 withdraws into solenoid 380 to permit actuator 375 to travel away from channel 372 and keeper 370. Any subsequent withdrawal force on door 104 forces keeper 370 to move in against actuator 375. Since the locking force of solenoid 380 has been withdrawn, the movement of keeper 370 against actuator 375 forces actuator 375 toward solenoid 380 along channel 376. Such actuator 375 movement permits keeper 370 to withdraw from its locking engagement against bolt 390 and subsequently unlocks door 104. Block 368 further defines a port 385 that accepts bolt 390.

Bolt 390 comprises an elongated, flat shaft 391. Shaft 391 extends from a flat base 392 to a terminal, split head 393. Bolt 390 preferably mounts appropriately on door 104 via attachment points 392A as is discussed more fully hereinafter. Preferably, head 393 forms an angle of entry 394 that is between 4 and 8 degrees, most preferably 6.5 degrees. The angle of entry 394 facilitates smooth bolt entry into the port.

An arcuate seat 395 is defined in shaft 391 between the base 392 and the split head 393. Bolt 390 preferably mounts appropriately on door 104 as is discussed more fully hereinafter. When bolt 390 is inserted fully into port 385, seat 395 may receive keeper 370. While keeper 370 is inserted and retained in seat 395 by actuator 375, door 104 remains locked. The walls of seat 395 form an angle of withdrawal 396 that is between 25 and 35 degrees, most preferably 30 degrees. When keeper 370 is released, the angle of withdrawal 396 forces keeper 370 out of seat 395.

In the preferred embodiment, the solenoid 180 draws 15 W of power while in a locked configuration. While in this locked configuration, a withdrawal force of 450 lbs is required to open door 104. Keeper sphere 174 and actuator sphere 178 transfer the withdrawal forces to the channel walls of block 168. Block 168 transfers the withdrawal forces to the frame 160. Frame 160 transfers the withdrawal forces to door jamb 102 via mounting hardware (bolts, screws, etc.).

Installation

Figure 24:
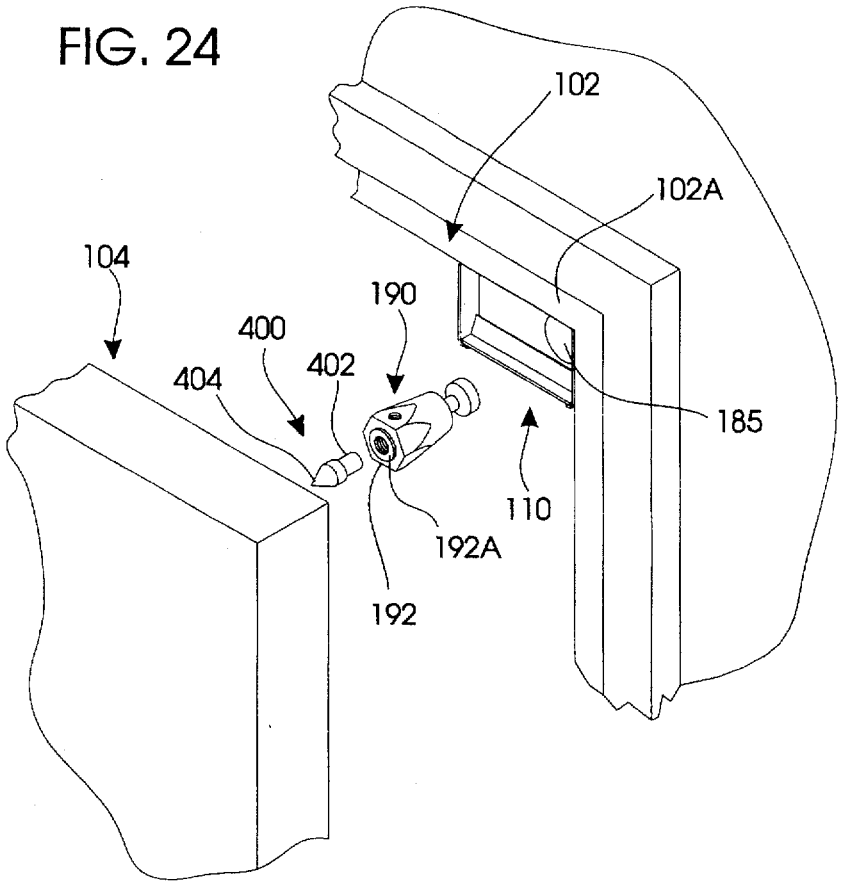
FIG. 24 is a partially exploded, fragmentary environmental view illustrating the marking dye used during installation of the preferred embodiment; and, FIG. 25 is a fragmentary environmental view with an arrow indicating door movement during installation.
Figure 25:
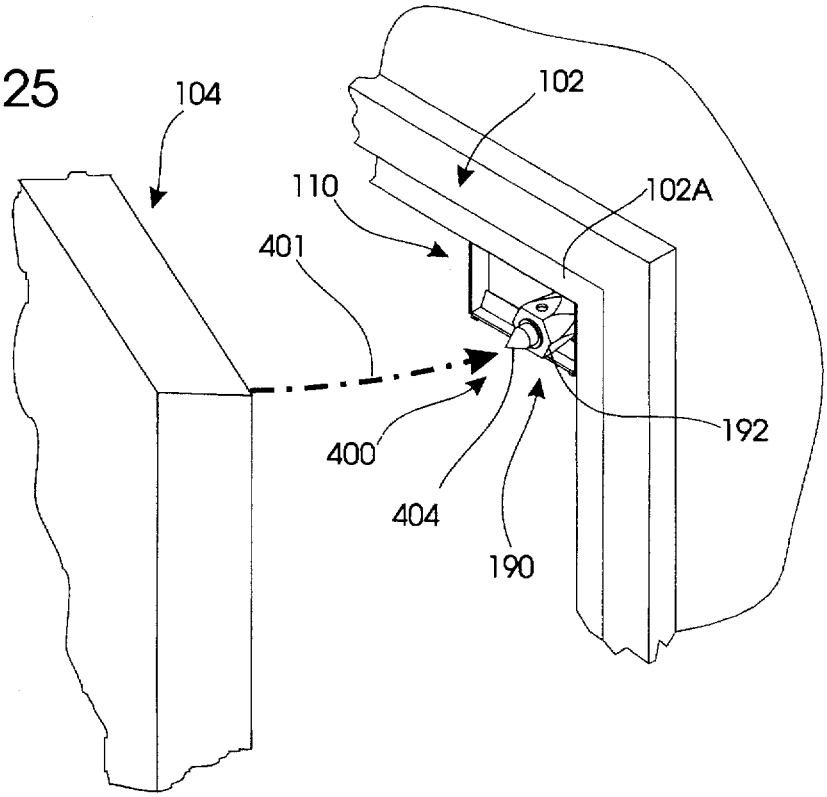

One significant advantage of system 100 over known prior art locks is the simplicity of the installation procedure for system 100. As can be most readily seen in FIGS. 24 and 25, system 100 can be easily installed in most environments with a minimum of effort.

The first step in installing system 100 is to secure mounting bracket 112 to door jamb 102 using conventional bolts, screws, etc. (FIG. 9). In practice, it has been found simplest to partially assemble latching mechanism 110 to ascertain the appropriate spacing from door 104 along jamb 102 for the mounting bracket location. After the mounting bracket 112 is rigidly affixed to door jamb 102, latching mechanism 110 and control module 105 can be conventionally secured to mounting bracket 112 on door jamb 102 as seen in FIG. 9. Of course, the control module can then be conventionally wired to the primary lock 120 or other triggering device.

Next, bolt 190 is simply inserted into port 185 and locked in place. A marking dye 400 is then placed on the attachment point 192A (or points 292A or 392A in the alternative embodiments) on base 192. With the marking dye appropriately placed, door 104 is forcibly closed as indicated by arrow 401. During closure, door 104 impacts upon marking dye 400. This impact imprints the proper location for attachment point 192A (or 292A or 392A) on door 104.

The marking dye 400 is then removed from the attachment point 192A (or 292A or 392A) and bolt 190 (or 290 or 390) is subsequently attached to door 104. In the preferred embodiment, dye 400 comprises a simple insert 402 with a pointed terminal tip 404. Of course, the dyes for each of the alternative embodiments would be identical except they would fit over attachment points 292A and 392A respectively instead of inserting into them.

The above described installation procedure quickly and efficiently permits system 100 to be retrofitted to existing primary locks 120 or installed independently.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An emergency exit door comprising:

a door with a primary paddle arm lock, an auxiliary door locking system triggered when said primary door lock is depressed, said system comprising:

a bolt comprising a body and an annular seat defined in said body;

a latching mechanism for receiving said bolt when said door is closed, said mechanism comprising:

keeper means for normally captivating said bolt, said keeper means comprising a displaceable spherical keeper adapted to selectively mate within said annular seat and a spherical actuator with a diameter at least two times larger than the diameter of said keeper for displacing said keeper when so activated by plunger means for selectively activating said spherical actuator;

a port aligned with said bolt for receiving same;

a first tubular channel defined in said mechanism intersecting said port for housing said keeper;

a second tubular channel defined in said mechanism terminally intersecting said first channel for housing said actuator and, timer means for temporarily delaying unlocking in response to the depression of said paddle arm lock.

2. The door as defined in claim 1 wherein said bolt further comprises an entry angle to facilitate bolt entry into said port and said seat comprises a displacement angle to dislodge said keeper therefrom during withdrawal from said port.

3. The door as defined in claim 2 wherein said entry angle is between four and eight degrees and said displacement angle is between twenty-five and thirty-five degrees.

4. The door as defined in claim 3 further comprising marking means for designating the location of said bolt on said door and wherein said bolt is adapted to selectively secure said marking means temporarily.

5. A fail safe auxiliary door locking system for use with a primary paddle arm lock to delay door opening, said system comprising:

a bolt comprising a body and an annular seat defined in said body;

a latching mechanism for receiving said bolt when said door is closed, said mechanism comprising:

keeper means for normally captivating said bolt, said keeper means comprising a displaceable keeper disposed within said mechanism for selectively engaging said annular seat, said keeper being spherical and adapted to mate within said seat, and an actuator being spherical for displacing said keeper when selectively activated by plunger means, said spherical actuator comprising a diameter larger than the diameter of said spherical keeper to geometrically increase the force necessary to withdraw said keeper while said keeper is mated in said seat;

a port aligned with said bolt for receiving same;

a first tubular channel defined in said mechanism intersecting said port for housing said keeper;

a second tubular channel defined in said mechanism terminally intersecting said first channel for housing said actuator; and, timer means for temporarily delaying unlocking in response to said primary door latch.

* * * * *